US005119131A

United States Patent [19]

Paolini et al.

[11] Patent Number: 5,119,131

[45] Date of Patent: Jun. 2, 1992

[54] ELECTROSTATIC VOLTMETER (ESV) ZERO OFFSET ADJUSTMENT

[75] Inventors: Anthony L. Paolini, W. Henrietta; Mark A. Scheuer, Williamson, both of N.Y.

[73] Assignee: Xerox Corporation, Stamford, Conn.

[21] Appl. No.: 755,192

[22] Filed: Sep. 5, 1991

[51] Int. Cl.[5] ..... G03G 21/00

[52] U.S. Cl. ..... 355/208; 355/328

[58] Field of Search ..... 355/203, 204, 205, 207, 355/208, 215, 326, 327, 328; 324/601

[56] References Cited

U.S. PATENT DOCUMENTS

| | | | |
|---|---|---|---|
| 3,013,890 | 12/1961 | Bixby | 117/17.5 |
| 3,045,644 | 7/1962 | Schwertz | 118/637 |
| 3,816,115 | 6/1974 | Gundlach et al. | 96/1.4 |
| 3,832,170 | 8/1974 | Nagamatsu et al. | 96/1.2 |
| 4,068,938 | 1/1978 | Robertson | 355/326 |
| 4,078,929 | 3/1978 | Gundlach | 96/1.2 |
| 4,308,821 | 1/1982 | Matsumoto et al. | 118/645 |
| 4,346,982 | 8/1982 | Nakajima et al. | 355/202 |
| 4,403,848 | 9/1983 | Snelling | 355/327 |
| 4,562,130 | 12/1985 | Oka | 430/54 |
| 4,588,667 | 5/1986 | Jones et al. | 430/73 |
| 4,654,284 | 3/1987 | Yu et al. | 430/59 |
| 4,731,634 | 3/1988 | Stark | 355/328 |
| 4,761,672 | 8/1988 | Parker et al. | 355/220 |
| 4,771,314 | 9/1988 | Parker et al. | 355/328 |
| 4,780,385 | 10/1988 | Wieloch et al. | 430/58 |
| 4,810,604 | 3/1989 | Schmidlin | 430/42 |
| 4,811,046 | 3/1989 | May . | |
| 4,833,504 | 5/1989 | Parker et al. | 355/326 |
| 4,847,655 | 7/1989 | Parker et al. | 355/210 |
| 4,868,600 | 9/1989 | Hays et al. | 355/259 |
| 4,868,608 | 9/1989 | Allen, Jr. et al. | 355/303 |
| 4,868,611 | 9/1989 | Germain | 355/328 |
| 4,901,114 | 2/1990 | Parker et al. | 355/245 |
| 4,913,348 | 4/1990 | Hays | 430/45 |
| 4,963,935 | 10/1990 | Kawabuchi | 355/245 |
| 4,980,725 | 12/1990 | Sumida | 355/245 |
| 4,984,022 | 1/1991 | Matsushita | 355/246 |
| 4,990,955 | 2/1991 | May et al. | 355/208 |
| 4,998,139 | 3/1991 | May et al. | 355/208 |
| 5,010,367 | 4/1991 | Hays | 355/247 |
| 5,010,368 | 4/1991 | O'Brien | 355/259 |
| 5,019,859 | 5/1991 | Nash | 355/77 |
| 5,021,838 | 6/1991 | Parker et al. | 355/328 |
| 5,032,872 | 7/1991 | Folkins et al. | 355/259 |
| 5,045,893 | 9/1991 | Tabb | 355/328 |
| 5,049,949 | 9/1991 | Parker | 355/328 |

*Primary Examiner*—A. T. Grimley
*Assistant Examiner*—Sandra L. Brasé

[57] ABSTRACT

In a single pass, tri-level imaging apparatus, erroneous voltage readings of an Electrostatic Voltmeter (ESV) which has become contaminated by charged particles (i.e. toner) are negated by using two ESVs.

During each cycle up following a normal cycle down, a pair of Electrostatic Voltmeters (ESVs) are utilized to measure the voltage level on a portion of relatively uncharged portion of a photoreceptor (P/R). Using one of the ESVs, which is less prone to contamination, as a reference, the zero offset of the other is adjusted to achieve the same residual P/R voltage reading. The difference in the readings which is due to toner contamination is the zero offset between the two ESVs. The offset is used to adjust all subsequent voltage readings of the ESV until a new offset is measured.

20 Claims, 4 Drawing Sheets

ELECTROSTATIC VOLTMETER (ESV) ZERO OFFSET ADJUSTMENT

CROSS-REFERENCES TO RELATED APPLICATIONS

U.S. patent application Ser. No. 07/755,194 filed on the same date as the this application and assigned to the same assignee as the instant application relates to a single pass tri-level imaging apparatus and method. Compensation for the effects of dark decay on the background voltage, $V_{Mod}$, and the color toner patch, $V_{tc}$ readings is provided using two ESVs ($ESV_1$ and $ESV_2$), the former located prior to the color or DAD housing and the latter after it. Since the CAD and black toner patch voltages are measured (using $ESV_2$) after dark decay and CAD voltage loss have occurred, no compensation for these readings is required. The DAD image voltage suffers little dark decay change over the life of the P/R so the average dark decay can be built into the voltage target.

U.S. patent application Ser. No. 07/755,193 filed on the same date as the this application and assigned to the same assignee as the instant application relates to toner patch generation for use in tri-level imaging which is effected using a laser ROS. Two toner patches are formed using a single toner patch generator of the type commonly used in the prior art. The patch generator, used by itself serves to form one toner patch latent image and together with the ROS exposure device of the imaging apparatus is used to form the other toner patch latent image.

U.S. patent application Ser. No. 07/755,473 filed on the same date as the this application and assigned to the same assignee as the instant application relates to a pair of Electrostatic Voltmeters (ESV) which are utilized to control the photoreceptor charging voltage in a Tri-Level imaging apparatus. One of the ESVs is used to control the voltage increases of a charging device. The other ESV is used to monitor the charge level of the charged area image of a Tri-Level image. When a critical value is sensed the control of the charging device is shifted to the ESV that monitors the charged area image level and limits the output from the charging device to a predetermined target value.

U.S. patent application Ser. No. 07/755,234 filed on the same date as the this application and assigned to the same assignee as the instant application relates to a single pass tri-level imaging apparatus, wherein a pair of Electrostatic Voltmeters (ESV) are utilized to monitor various control patch voltages to allow for feedback control of Infra-Red Densitometer (IRD) readings.

The ESV readings are used to adjust the IRD readings of each toner patch. For the black toner patch, readings of an ESV positioned between two developer housing structures are used to monitor the patch voltage. If the voltage is above target (high development field) the IRD reading is increased by an amount proportional to the voltage error. For the color toner patch, readings using an ESV positioned upstream of the developer housing structures and the dark decay projection to the color housing are used to make a similar correction to the color toner patch IRD readings (but opposite in sign because, for color, a lower voltage results in a higher development field).

U.S. patent application Ser. No. 07/755,279 filed on the same date as the this application and assigned to the same assignee as the instant application relates to toner dispensing rate adjustment wherein the Infra-Red Densitometer (IRD) readings of developed toner patches in a tri-level imaging apparatus are compared to target values stored in Non-Volitale Memory (NVM) and are also compared to the previous IRD reading. Toner dispensing decisions (i.e. addition or reduction) are based on both comparisons. In this manner, not only are IRD readings examined as to how far the reading is from the target, they are examined as to current trend (i.e. whether the reading is moving away from or toward the target).

U.S. patent application Ser. No. 07/755,467 filed on the same date as the this application and assigned to the same assignee as the instant application relates to a tri-level imaging apparatus wherein two sets of targets, one for use during cycle up convergence of electrostatics and one during runtime enable single pass cleaning of developed patches, during cycle up convergence. To this end, different targets from those used during runtime are used for the preclean, transfer and pretransfer dicorotrons during cycle up.

Proper charging of the photoreceptor during runtime and cycle up convergence is also enabled by the provision of two charging targets, one for each mode of operation.

U.S. patent application Ser. No. 07/755,196 filed on the same date as the this application and assigned to the same assignee as the instant application relates to cycle up convergence of electrostatics in a tri-level imaging apparatus wherein cycle up convergence is shortened through the use of an image output terminal (IOT) resident image (on a pixel or control board) to obtain charge, discharge and background voltage readings on every pitch.

U.S. patent application Ser. No. 07/755,379 filed on the same date as the this application and assigned to the same assignee as the instant application relates to recalculation of electrostatic target values in a tri-level imaging apparatus to extend the useful life of the photoreceptor (P/R). The increase in residual voltage due to P/R aging which would normally necessitate P/R disposal is obviated by resetting the target voltage for the full ROS exposure when it reaches its exposure limit with current P/R conditions. All contrast voltage targets are then recalculated based on this new target.

The new targets are calculated based on current capability of the overall system and the latitude is based on voltage instead of exposure.

U.S. patent application Ser. No. 07/755,197 filed on the same date as the this application and assigned to the same assignee as the instant application relates to the use of Infra-Red Densitometer (IRD) readings to check the efficiency of two-pass cleaning of the black toner patch in a tri-level imaging apparatus. The IRD examines the background patch of the tri-level image and declares a machine fault if excessive toner is detected.

U.S. patent application Ser. No. 07/755,206 filed on the same date as the this application and assigned to the same assignee as the instant application relates to a single pass, tri-level imaging apparatus, machine cycle down which is initiated when the color developer housing is functioning improperly. The voltage level of the color image prior to its development is read using an electrostatic voltmeter (ESV). The voltage level thereof is also read after development. The difference between these two readings is compared to an arbitrary target value and a machine cycle down is initiated if the difference is greater that the target.

BACKGROUND OF THE INVENTION

This invention relates generally to highlight color imaging and more particularly to the formation of tri-level highlight color images in a single pass.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided into three levels, rather than two levels as is the case in conventional xerography. The photoreceptor is charged, typically to −900+ volts. It is exposed imagewise, such that one image corresponding to charged image areas (which are subsequently developed by charged-area development, i.e. CAD) stays at the full photoreceptor potential ($V_{cad}$ or $V_{ddp}$). $V_{ddp}$ is the voltage on the photoreceptor due to the loss of voltage while the P/R remains charged in the absence of light, otherwise known as dark decay. The other image is exposed to discharge the photoreceptor to its residual potential, i.e. $V_{dad}$ or $V_c$ (typically −100 volts) which corresponds to discharged area images that are subsequently developed by discharged-area development (DAD) and the background area is exposed such as to reduce the photoreceptor potential to halfway between the $V_{cad}$ and $V_{dad}$ potentials, (typically −500 volts) and is referred to as $V_{white}$ or $V_w$. The CAD developer is typically biased about 100 volts closer to $V_{cad}$ than $V_{white}$ (about −600 volts), and the DAD developer system is biased about −100 volts closer to $V_{dad}$ than $V_{white}$ (about 400 volts). As will be appreciated, the highlight color need not be a different color but may have other distinguishing characteristics. For, example, one toner may be magnetic and the other non-magnetic.

Following is a discussion of prior art which may bear on the patentability of the present invention. In addition to possibly having some relevance to the patentability thereof, these references, together with the detailed description to follow hereinafter, may provide a better understanding and appreciation of the present invention.

A method of producing images in plural (i.e. two colors, black and one highlight color) is disclosed in U.S. Pat. No. 3,013,890 To W. E. Bixby in which a charge pattern of either a positive or negative polarity is developed by a single, two-colored developer. The developer of Bixby comprises a single carrier which supports both triboelectrically relatively positive and relatively negative toner. The positive toner is a first color and the negative toner is of a second color. The method of Bixby develops positively charged image areas with the negative toner and develops negatively charged image areas with the positive toner. A two-color image occurs only when the charge pattern includes both positive and negative polarities.

Plural color development of charge patterns can be created by the Tesi technique. This is disclosed by F. A. Schwertz in U.S. Pat. No. 3,045,644. Like Bixby, Schwertz develops charge patterns which are of both a positive and negative polarity. Schwertz's development system is a set of magnetic brushes, one of which applies relatively positive toner of a first color to the negatively charged areas of the charge pattern and the other of which applies relatively negative toner to the positively charged areas.

Methods and apparatus for making color xerographic images using colored filters and multiple development and transfer steps are disclosed, respectively, in U.S. Pat. Nos. 3,832,170 to K. Nagamatsu et al and 3,838,919 to T. Takahashi.

U.S. Pat. No. 3,816,115 to R. W. Gundlach and L. F. Bean discloses a method for forming a charge pattern having charged areas of a higher and lower strength of the same polarity. The charge pattern is produced by repetitively charging and imagewise exposing an overcoated xerographic plate to form a composite charge pattern. Development of the charge pattern in one color is disclosed.

A method of two-color development of a charge pattern, preferably with a liquid developer, is disclosed in the commonly assigned U.S. Pat. No. 4,068,938 issued on Jan. 17, 1978. This method requires that the charge pattern for attracting a developer of one color be above a first threshold voltage and that the charge pattern for attracting the developer of the second color be below a second threshold voltage. The second threshold voltage is below the first threshold voltage. Both the first and second charge patterns have a higher voltage than does the background.

As disclosed in U.S. Pat. No. 4,403,848, a multi-color printer uses an additive color process to provide either partial or full color copies. Multiple scanning beams, each modulated in accordance with distinct color image signals, are scanned across the printer's photoreceptor at relatively widely separated points, there being buffer means provided to control timing of the different color image signals to assure registration of the color images with one another. Each color image is developed prior to scanning of the photoreceptor by the next succeeding beam. Following developing of the last color image, the composite color image is transferred to a copy sheet. In an alternate embodiment, an input section for scanning color originals is provided. The color image signals output by the input section may then be used by the printing section to make full color copies of the original.

U.S. Pat. No. 4,562,130 relates to a composite image forming method having the following features: (A) Forming a composite latent electrostatic image of potentials at three different levels by two image exposures, the potential of the background area (nonimage area) resulting from the first image exposure is corrected to a stable intermediate potential which is constant at all times by charging the area with scorotron charging means. Accordingly, the image can be developed to a satisfactory copy image free from fog. (B) The composite latent electrostatic image is developed by a single developing device collectively, or by two developing devices. In the latter case, the composite latent image is not developed after it has been formed, but the latent image resulting from the first exposure is developed first before the second exposure, and the latent image resulting from the second exposure is thereafter developed, whereby the fog due to an edging effect is prevented whereby there is produced a satisfactory copy image.

In U.S. Pat. No. 4,346,982, there is disclosed an electrophotographic recording device having means for uniformly charging the surface of a light-sensitive recording medium, means for forming latent images on said light-sensitive recording medium and means for developing said latent images into visual images, said electrophotographic recording device being characterized in that said means for forming latent images on said light-sensitive recording medium comprises a plurality of exposing means for exposing a positive optical image and a negative optical image in such a manner that the light receiving region of said negative optical image overlaps the light receiving region of said positive optical image, whereby a latent image is formed on the surface of said light-sensitive recording medium consisting of a first area which does not receive any light of said negative or positive image and holds an original potential, a second area which receives the light of only said positive image and holds a reduced potential from that of said original potential and a third area which receives the light of both of said negative image and said positive image and holds a further reduced potential than said reduced potential of said second area.

U.S. Pat. No. 4,731,634 granted to Howard M. Stark on Mar. 15, 1988 discloses a method and apparatus for rendering latent electrostatic images visible using multiple colors of dry toner or developer and more particularly to printing toner images in black and at least two highlighting colors in a single pass of the imaging surface through the processing areas of the printing apparatus. A four level image is utilized for forming a black and two highlight color image areas and a background area, all having different voltage levels. Two of the toners are attracted to only one charge level on a charge retentive surface thereby providing black and one highlight color image while two toners are attracted to another charge level to form the second highlight color image.

U.S. Pat. No. 5,032,872 granted to Folkins et al on Jul. 16, 1991 discloses an apparatus for developing a latent image recorded on a photoconductive member in an electrophotographic printing machine having a reservoir for storing a supply of developer material and a magnetic brush roll for transporting material from the reservoir to each of two donor rolls. The developer material has carrier granules and toner particles. The donor rolls receive toner particles from the magnetic brush roll and deliver the toner particles to the photoconductive member at spaced locations in the direction of movement of the photoconductive member to develop the latent image recorded thereon.

U.S. Pat. No. 5,021,838 granted to Parker et al on Jun. 4, 1991 relates to a tri-Level highlight color imaging apparatus utilizing two-component developer materials in each of a plurality of developer housings. The triboelectric properties of the toners and carriers forming the two-component developers are such that intermixing of the components of each developer with the components in another developer housing is minimized.

U.S. Pat. No. 5,019,859 granted to Thomas W. Nash on May 28, 1991 relates to a highlight color imaging apparatus and method for creating highlight color images that allows the inter-image areas to be used for developability or other control functions notwithstanding the necessity of developer switching. The black and highlight color images are separately formed and the order of image formation is one where the black image (B1) for the first copy is formed, followed by the highlight color image (C1) for the first copy; then the highlight color image (C2) for the second copy; then the black image (B2) for the second copy; then the black image (B3) for the third copy and finally the highlight color image (C3) for the third copy. With the foregoing order of image creation, developer switching is not required when two adjacent images are the same color. When developer switching is not required the inter-image area can be used for process control such as developability to form a test pattern threat. Thus, in the example above, the area between the two adjacent color images (C1, C2) is available for forming a color test patch. Likewise, the area between the two black images (B2, B3), is available for forming a black test patch.

U.S. Pat. No. 5,010,368 granted to John F. O'Brien on Apr. 23, 1991 discloses an apparatus which develops a latent image recorded on a photoconductive member in an electrophotographic printing machine. The apparatus includes a housing having a chamber storing a supply of developer material, a magnetic transport roll, a donor roll and a developer roll magnetic. The developer material includes carrier and toner. The magnetic transport roll delivers developer material to the magnetic developer roll and toner to the donor roll. Toner is delivered from the magnetic developer roll and donor roll to the photoconductive member to develop the latent image.

U.S. Pat. No. 4,998,139 granted to Parker on Mar. 5, 1991 discloses, in a tri-level imaging apparatus, a development control arrangement wherein the white discharge level is stabilized at a predetermined voltage and the bias voltages for the developer housings for charged area and discharged area development are independently adjustable for maintaining image background levels within acceptable limits. The white discharge level can be shifted to preferentially enhance the copy quality of one or the other of the charged area or discharged area images.

U.S. Pat. No. 4,990,955 granted to Parker et al on Feb. 5, 1991 relates to the stabilization of the white or background discharge voltage level of tri-level images by monitoring photoreceptor white discharge level in the inter-document area of the photoreceptor using an electrostatic voltmeter. The information obtained thereby is utilized to control the output of a raster output scanner so as to maintain the white discharge level at a predetermined level.

U.S. Pat. No. 4,984,022 granted to Matsushita et al on Jan. 8, 1991 discloses an image forming apparatus including a photosensitive member, a developing sleeve for developing an electrostatic latent image formed on the photosensitive member by using a developer, and control means for controlling the application of bias voltage to the sleeve wherein the bias voltage is controlled so as to be maintained a predetermined time period after the image formation is interrupted.

U.S. Pat. No. 4,980,725 granted to Hiroyasu Sumida on Dec. 25, 1990 discloses that when it is desired to provide a particular region of an image of a document with a background which is different in color from the background of the other region, an image forming apparatus controls the amount of toner supply for implementing the background of the particular region to produce a solid image of density which remains constant at all times in the particular region. The amount of toner fed to a developing unit for producing the solid image is controlled in matching relation to the area of a desired solid image region or a ratio of magnification change.

U.S. Pat. No. 4,963,935 granted to Yoichi Kawabuchi on Oct. 16, 1990 relates to a copying apparatus provided with a plurality of developing units including a simultaneous multi-color copying control device for controlling to obtain an image in a plurality of colors by causing the plurality of developing units to be changed over for functioning during one copying operation, a simultaneous multi-color copying selecting device for selecting a simultaneous multi-color copying mode for effecting copying by the simultaneous multi-color copying control, and a developing unit selecting device for selecting the developing unit to be used from the plurality of developing units. The copying apparatus is so arranged that input from the developing unit selecting device is inhibited when the simultaneous multi-color copying mode has been selected.

U.S. Pat. No. 4,913,348 granted to Dan A. Hays on Apr. 3, 1990 relates an electrostatic charge pattern formed on a charge retentive surface. The charge pattern comprises charged image areas and discharged background areas. The fully charged image areas are at a voltage level of approximately −500 volts and the background is at a voltage level of approximately −100 volts. A spatial portion of the image area is used to form a first image with a narrow development zone while other spatial portions are used to form other images which are distinct from the first image in some physical property such as color or magnetic state. The development is rapidly turned on and off by a combination of AC and DC electrical switching. Thus, high spatial resolution multi-color development in the process direction can be obtained in a single pass of the charge retentive surface through the processing stations of a copying or printing apparatus. Also, since the voltages representing all images are at the same voltage polarity unipolar toner can be employed.

U.S. Pat. No. 4,901,114 granted to Parker et al on Feb. 13, 1990 discloses an electronic printer employing tri-level xerography to superimpose two images with perfect registration during the single pass of a charge retentive member past the processing stations of the printer. One part of the composite image is formed using MICR toner, while the other part of the image is printed with less expensive black, or color toner. For example, the magnetically readable information on a check is printed with MICR toner and the rest of the check in color or in black toner that is not magnetically readable.

U.S. Pat. No. 4,868,611 granted to Richard P. Germain on September, 1989 relates to a highlight color imaging method and apparatus including structure for forming a single polarity charge pattern having at least three different voltage levels on a charge retentive surface wherein two of the voltage levels correspond to two image areas and the third voltage level corresponds to a background area. Interaction between developer materials contained in a developer housing and an already developed image in one of the two image areas is minimized by the use of a scorotron to neutralize the charge on the already developed image.

U.S. Pat. No. 4,868,608 granted to Allen et al on Sep. 19, 1989 discloses a tri-Level Highlight color imaging apparatus and cleaner apparatus therefor. Improved cleaning of a charge retentive surface is accomplished through matching the triboelectric properties of the positive and negative toners and their associated carriers as well as the carrier used in the magnetic brush cleaner apparatus. The carrier in the cleaner upon interaction with the two toners causes them to charge to the same polarity. The carrier used in the cleaner is identical to the one use in the positive developer. The carrier of the negative developer was chosen so that the toner mixed therewith charged negatively in the developer housing. Thus, the combination of toners and carriers is such that one of the toners charges positively against both carriers and the other of the toners charges negatively against one of the carriers and positively against the other. Due to the application of a positive pretransfer corona both the toners are positive when they reach the cleaner housing and because the carrier employed causes both of the toners to charge positively, toner polarity reversal is precluded.

U.S. Pat. No. 4,847,655 granted to Parker et al on Jul. 11, 1989 discloses a magnetic brush developer apparatus including a plurality of developer housings each including a plurality of magnetic brush rolls associated therewith. Conductive magnetic brush (CMB) developer is provided in each of the developer housings. The CMB developer is used to develop electronically formed images. The physical properties such as conductivity, toner concentration and toner charge level of the CMB developers are such that density fine lines are satisfactorily developed notwithstanding the presence of relatively high cleaning fields.

U.S. Pat. No. 4,811,046 granted to Jerome E. May on Mar. 7, 1989 discloses that Undesirable transient development conditions that occur during start-up and shutdown in a tri-level xerographic system when the developer biases are either actuated or de-actuated are obviated by the provision of developer apparatuses having rolls which are adapted to be rotated in a predetermined direction for preventing developer contact with the imaging surface during periods of start-up and shut-down. The developer rolls of a selected developer housing or housings can be rotated in a the contact-preventing direction to permit use of the tri-level system to be utilized as a single color system or for the purpose of agitating developer in only one of the housings at time to insure internal triboelectric equilibrium of the developer in that housing.

U.S. Pat. No. 4,771,314 granted to Parker et al on Sep. 13, 1988 relates to printing apparatus for forming toner images in black and at least one highlighting color in a single pass of a change retentive imaging surface through the processing areas, including a development station, of the printing apparatus. The development station includes a pair of developer housings each of which has supported therein a pair of magnetic brush development rolls which are electrically biased to provide electrostatic development and cleaning fields between the charge retentive surface and the developer rolls. The rolls are biased such that the development fields between the first rolls in each housing and the charge retentive surface are greater than those between the charge retentive surface and the second rolls and such that the cleaning fields between the second rolls in each housing and the charge retentive surface are greater than those between the charge retentive surface and the first rolls.

U.S. Pat. No. 4,761,672 granted to Parker et al on Aug. 2, 1988 relates to undesirable transient development conditions that occur during start-up and shut-down in a tri-level xerographic system when the developer biases are either actuated or de-actuated are obviated by using a control strategy that relies on the exposure system to generate a spatial ramp on the photoreceptor during machine start-up and shut-down. Furthermore, the development systems' bias supplies are programmed so that their bias voltages follow the photoreceptor voltage ramp at some predetermined offset voltage. This offset is chosen so that the cleaning field between any development roll and the photoreceptor is always within reasonable limits. As an alternative to synchronizing the exposure and developing characteristics, the charging of the photoreceptor can be varied in accordance with the change of developer bias voltage.

U.S. Pat. No. 4,308,821 granted on Jan. 5, 1982 to Matsumoto, et al. discloses an electrophotographic development method and apparatus using two magnetic brushes for developing two-color images which allegedly do not disturb or destroy a first developed image during a second development process. This is because a second magnetic brush contacts the surface of a latent electrostatic image bearing member more lightly than a first magnetic brush and the toner scraping force of the second magnetic brush is reduced in comparison with that of the first magnetic brush by setting the magnetic flux density on a second non-magnetic sleeve with an internally disposed magnet smaller than the magnetic flux density on a first magnetic sleeve, or by adjusting the distance between the second non-magnetic sleeve and the surface of the latent electrostatic image bearing members. Further, by employing toners with different quantity of electric charge, high quality two-color images are obtained.

U.S. Pat. No. 4,833,504 granted on May 23, 1989 to Parker et al discloses a magnetic brush developer apparatus comprising a plurality of developer housings each including a plurality of magnetic rolls associated therewith. The magnetic rolls disposed in a second developer housing are constructed such that the radial component of the magnetic force field produces a magnetically free development zone intermediate to a charge retentive surface and the magnetic rolls. The developer is moved through the zone magnetically unconstrained and, therefore, subjects the image developed by the first developer housing to minimal disturbance. Also, the developer is transported from one magnetic roll to the next. This apparatus provides an efficient means for developing the complimentary half of a tri-level latent image while at the same time allowing the already developed first half to pass through the second housing with minimum image disturbance.

U.S. Pat. No. 4,810,604 granted to Fred W. Schmidlin on Mar. 7, 1989 discloses a printing apparatus wherein highlight color images are formed. A first image is formed in accordance with conventional (i.e. total voltage range available) electrostatic image forming techniques. A successive image is formed on the copy substrate containing the first image subsequent to first image transfer, either before or after fusing, by utilization of direct electrostatic printing.

U.S. Pat. No. 4,868,600 granted to Hays et al on Sep. 19, 1989 and assigned to the same assignee as the instant application discloses a scavengeless development system in which toner detachment from a donor and the concomitant generation of a controlled powder cloud is obtained by AC electric fields supplied by self-spaced electrode structures positioned within the development nip. The electrode structure is placed in close proximity to the toned donor within the gap between the toned donor and image receiver, self-spacing being effected via the toner on the donor. Such spacing enables the creation of relatively large electrostatic fields without risk of air breakdown.

U.S. patent application Ser. No. 424,482 filed on Oct. 20, 1989 and assigned to the same assignee as the instant application discloses a scavengeless development system for use in highlight color imaging. AC biased electrodes positioned in close proximity to a magnetic brush structure carrying a two-component developer cause a controlled cloud of toner to be generated which non-interactively develops an electrostatic image. The two-component developer includes mixture of carrier beads and toner particles. By making the two-component developer magnetically tractable, the developer is transported to the development zone as in conventional magnetic brush development where the development roll or shell of the magnetic brush structure rotates about stationary magnets positioned inside the shell.

U.S. Pat. No. 5,010,376 discloses a scavengeless/non-interactive development system for use in highlight color imaging. To control the developability of lines and the degree of interaction between the toner and receiver, the combination of an AC voltage on a developer donor roll with an AC voltage between toner cloud forming wires and donor roll enables efficient detachment of toner from the donor to form a tonor cloud and position one end of the cloud in the close proximity to the image receiver for optimum development of lines and solid areas without scavenging a previously toned image. In this device the frequencies of the AC voltages applied between the donor and image receiver and between the wires and the donor roll are in the order of 4 to 10 kHz. While a range of frequencies is specified in the '367 patent the two voltages referred to are applied at the same frequency as evidenced by the fact that the donor and wire voltages are specified as being either in-phase or out-of-phase. If the two frequencies were not the same, when out-of-phase voltages are used then the two voltages would at some point in time be in phase. Likewise, if when in-phase voltages were used, the frequencies were not the same then at some point in time the two voltages would, at some point in time, be out-of-phase. In other words, if the two voltages of the '367 patent were different, the phase relationship of the two voltages could not be maintained overtime.

BRIEF SUMMARY OF THE INVENTION

Erroneous voltage readings of an Electrostatic Voltmeter (ESV) which has become contaminated by charged particles (i.e. toner) are negated by using two ESVs.

During each cycle up following a normal cycle down, a pair of Electrostatic Voltmeters (ESVs), $ESV_1$ and $ESV_2$ are utilized to measure the voltage level on a portion of the photoreceptor that has been erased by a multi-functional erase lamp but not charged by the charging system. Using $ESV_1$, which is less prone to contamination, as a reference, the zero offset of $ESV_2$ adjusted to achieve the same residual P/R voltage reading as $ESV_1$. The difference in the readings which is due to toner contamination of $ESV_2$ is the zero offset between the two ESVs. The offset is used to adjust all subsequent $ESV_2$ voltage readings until a new offset is measured.

DETAILED DESCRIPTION OF THE PREFERRED EMBODIMENT OF THE INVENTION

Figure 1A:
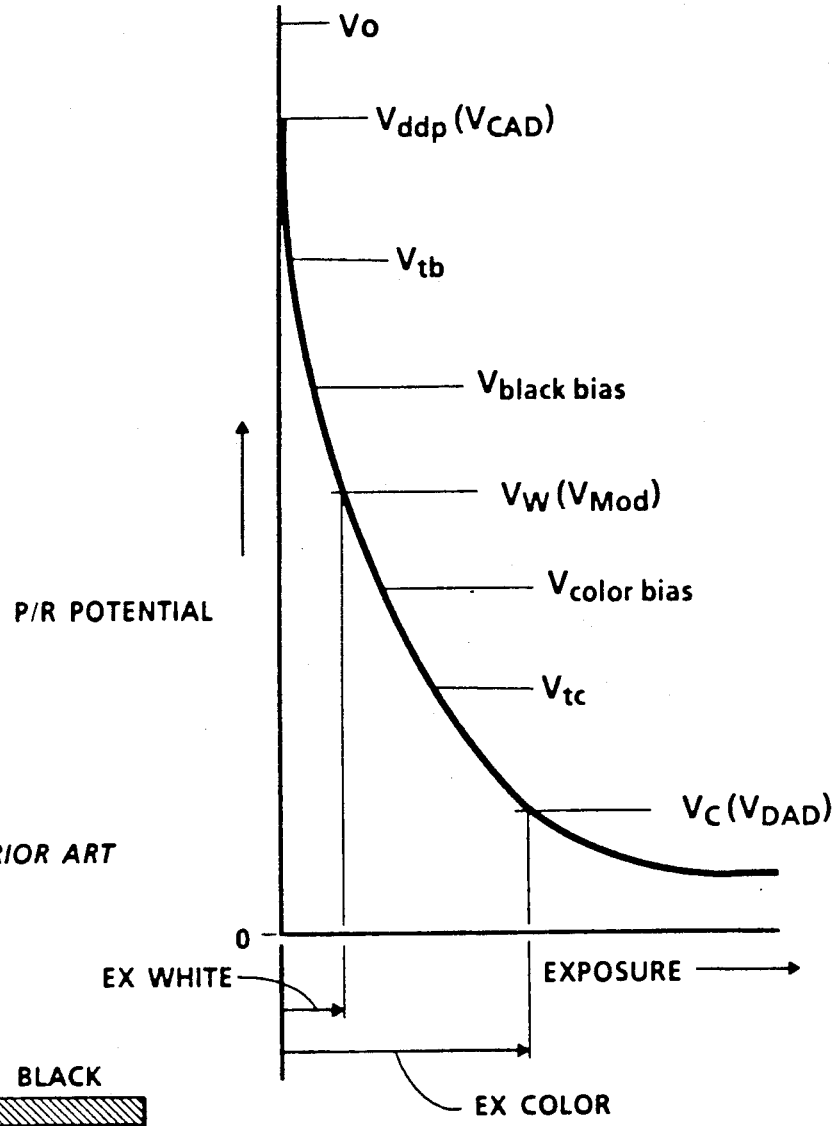
PRIOR ART FIG. 1a
FIG. 1*a* is a plot of photoreceptor potential versus exposure illustrating a tri-level electrostatic latent image.
Figure 1B:
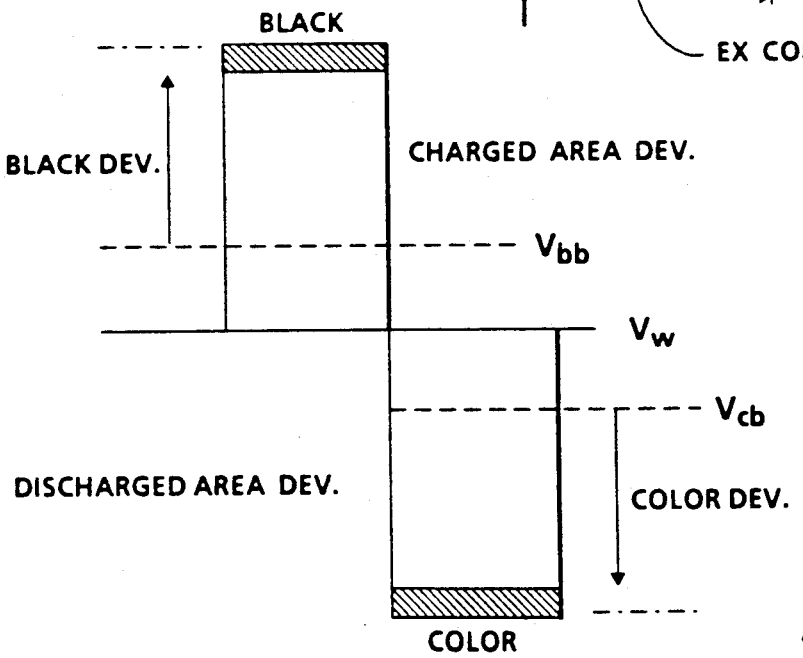
PRIOR ART FIG. 1b
FIG. 1*b* is a plot of photoreceptor potential illustrating singlepass, highlight color latent image characteristics.

For a better understanding of the concept of tri-level, highlight color imaging, a description thereof will now be made with reference to FIGS. 1*a* and 1*b*. FIG. 1*a* shows a PhotoInduced Discharge Curve (PIDC) for a tri-level electrostatic latent image according to the present invention. Here $V_0$ is the initial charge level, $V_{ddp}$ ($V_{CAD}$) the dark discharge potential (unexposed), $V_w$($V_{Mod}$) the white or background discharge level and $V_c$ ($V_{DAD}$) the photoreceptor residual potential (full exposure using a three level Raster Output Scanner, ROS). Nominal voltage values for $V_{CAD}$, $V_{Mod}$ and $V_{DAD}$ are, for example, 788,423 and 123, respectively.

Color discrimination in the development of the electrostatic latent image is achieved when passing the photoreceptor through two developer housing in tandem or in a single pass by electrically biasing the housings to voltages which are offset from the background voltage $V_{Mod}$, the direction of offset depending on the polarity or sign of toner in the housing. One housing (for the sake of illustration, the second) contains developer with black toner having triboelectric properties (positively charged) such that the toner is driven to the most highly charged ($V_{ddp}$) areas of the latent image by the electrostatic field between the photoreceptor and the development rolls biased at $V_{black\ bias}$ ($V_{bb}$) as shown in FIG. 1*b*. Conversely, the triboelectric charge (negative charge) on the colored toner in the first housing is chosen so that the toner is urged towards parts of the latent image at residual potential, $V_{DAD}$ by the electrostatic field existing between the photoreceptor and the development rolls in the first housing which are biased to $V_{color\ bias}$, ($V_{cb}$). Norminal voltage levels for $V_{bb}$ and $V_{cb}$ are 641 and 294, respectively.

Figure 2:
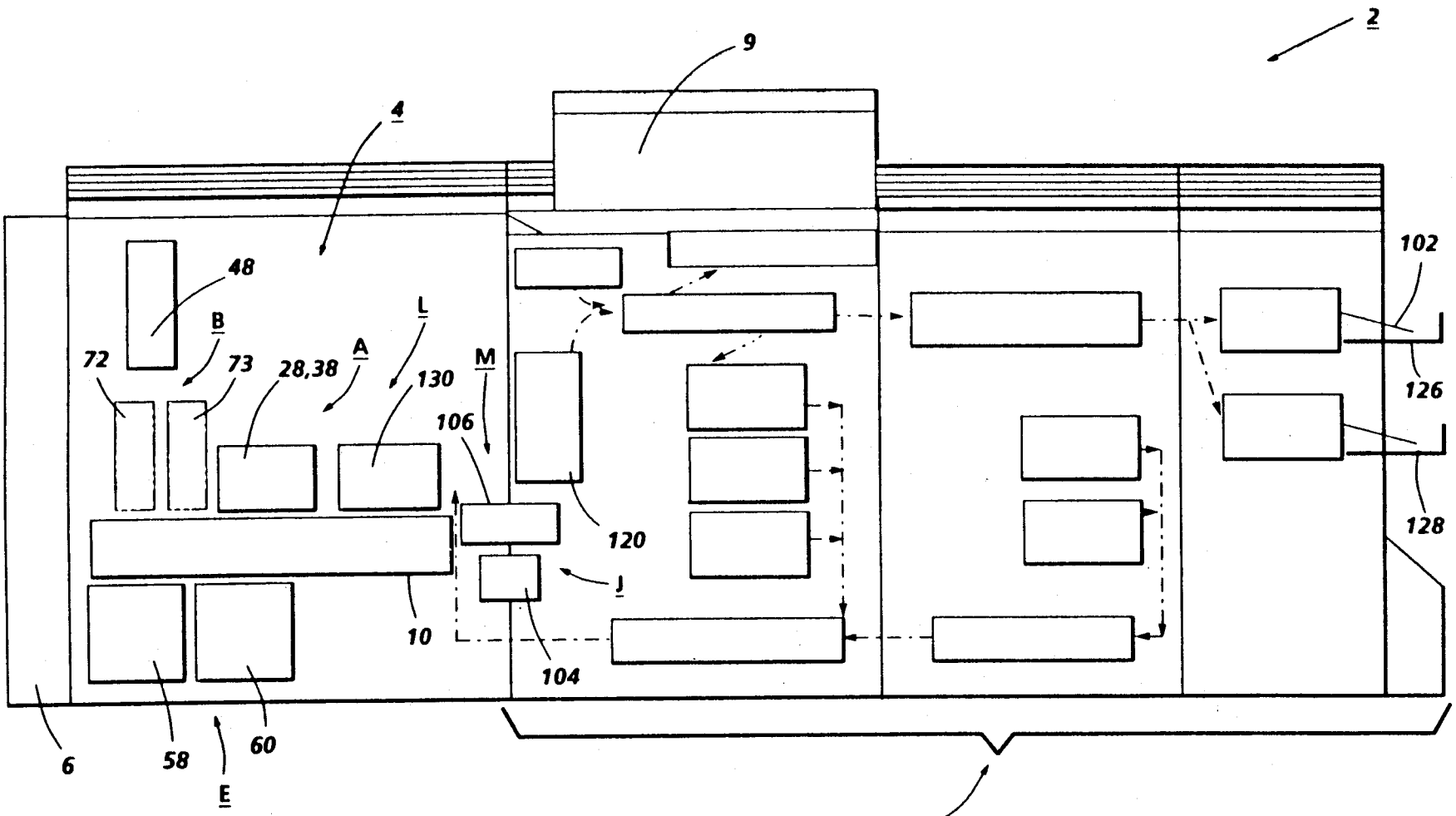
FIG. 2 is schematic illustration of a printing apparatus incorporating the inventive features of the invention.
Figure 3:
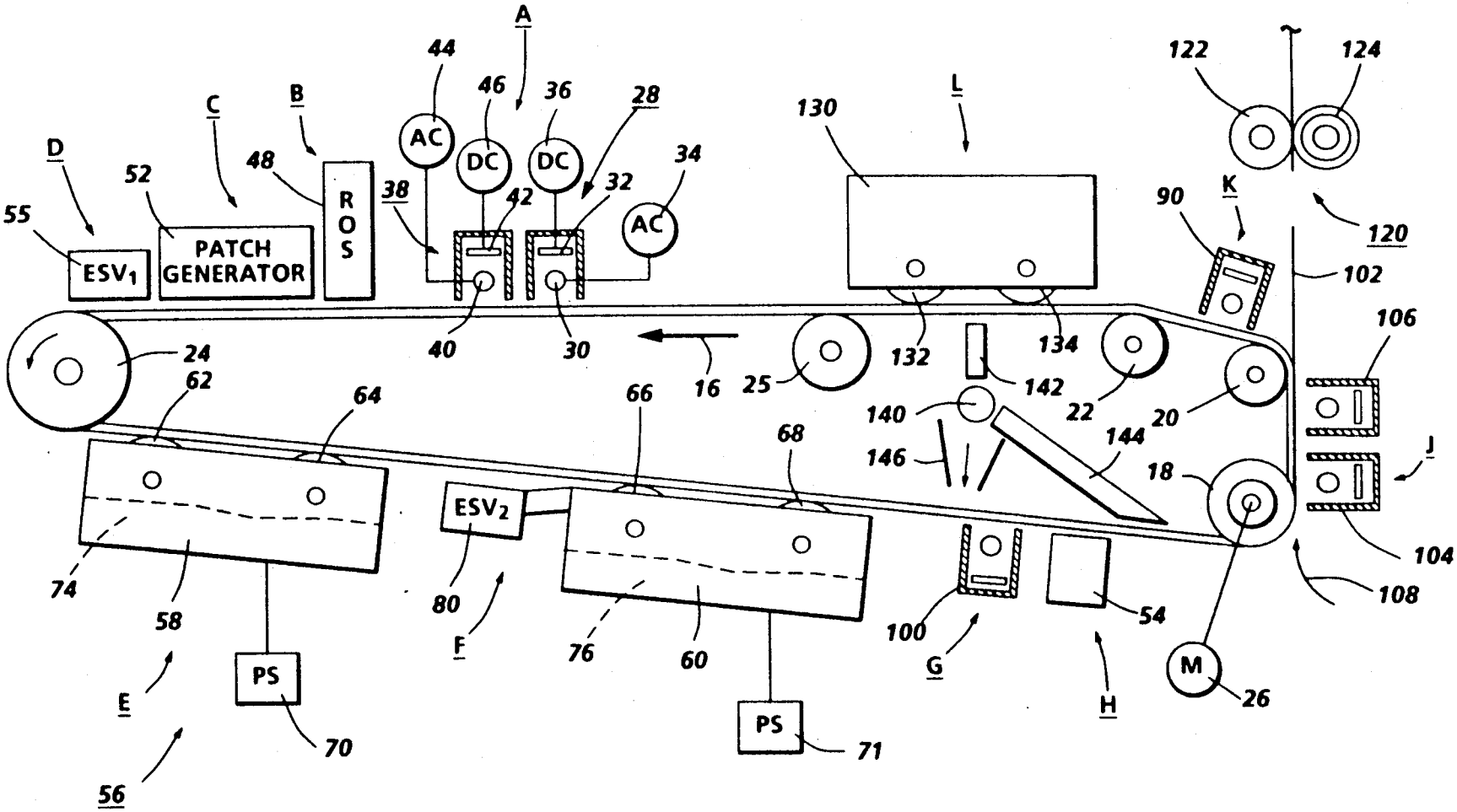
FIG. 3 a schematic of the xerographic process stations including the active members or image formation as well as the control members operatively associated therewith of the printing apparatus illustrated in FIG. 2.

As shown in FIGS. 2 and 3, a highlight color printing apparatus 2 in which the invention may be utilized comprises a xerographic processor module 4, an electronics module 6, a paper handling module 8 and a user interface (IC) 9. A charge retentive member in the form of an Active Matrix (AMAT) photoreceptor belt 10 is mounted for movement in an endless path past a charging station A, an exposure station B, a test patch generator station C, a first Electrostatic Voltmeter (ESV) station D, a developer station E, a second ESV station F within the developer station E, a pretransfer station G, a toner patch reading station H where developed toner patches are sensed, a transfer station J, a preclean station K, cleaning station L and a fusing station M. Belt 10 moves in the direction of arrow 16 to advance successive portions thereof sequentially through the various processing stations disposed about the path of movement thereof. Belt 10 is entrained about a plurality of rollers 18, 20, 22, 23 and 24, the former of which can be used as a drive roller and the latter of which can be used to provide suitable tensioning of the photoreceptor belt 10. Motor 26 rotates roller 18 to advance belt 10 in the direction of arrow 16. Roller 18 is coupled to motor 26 by suitable means such as a belt drive, not shown. The photoreceptor belt may comprise a flexible belt photoreceptor. Typical belt photoreceptors are disclosed in U.S. Pat. Nos. 4,588,667, 4,654,284 and 4,780,385.

As can be seen by further reference to FIGS. 2 and 3, initially successive portions of belt 10 pass through charging station A. At charging station A, a primary corona discharge device in the form of dicorotron indicated generally by the reference numeral 28, charges the belt 10 to a selectively high uniform negative potential, $V_0$. As noted above, the initial charge decays to a dark decay discharge voltage, $V_{ddp}$, ($V_{CAD}$). The dicorotron is a corona discharge device including a corona discharge electrode 30 and a conductive shield 32 located adjacent the electrode. The electrode is coated with relatively thick dielectric material. An AC voltage is applied to the dielectrically coated electrode via power source 34 and a DC voltage is applied to the shield 32 via a DC power supply 36. The delivery of charge to the photoconductive surface is accomplished by means of a displacement current or capacitative coupling through the dielectric material. The flow of charge to the P/R 10 is regulated by means of the DC bias applied to the dicorotron shield. In other words, the P/R will be charged to the voltage applied to the shield 32. For further details of the dicorotron construction and operation, reference may be had to U.S. Pat. No. 4,086,650 granted to Davis et al on Apr. 25, 1978.

A feedback dicorotron 38 comprising a dielectrically coated electrode 40 and a conductive shield 42 operatively interacts with the dicorotron 28 to form an integrated charging device (ICD). An AC power supply 44 is operatively connected to the electrode 40 and a DC power supply 46 is operatively connected to the conductive shield 42.

Next, the charged portions of the photoreceptor surface are advanced through exposure station B. At exposure station B, the uniformly charged photoreceptor or charge retentive surface 10 is exposed to a laser based input and/or output scanning device 48 which causes the charge retentive surface to be discharged in accordance with the output from the scanning device. Perferably the scanning device is a three level laser Raster Output Scanner (ROS). Alternatively, the ROS could be replaced by a conventional xerographic exposure device. The ROS comprises optics, sensors, laser tube and resident control or pixel board.

The photoreceptor, which is initially charged to a voltage $V_0$, undergoes dark decay to a level $V_{ddp}$ or $V_{CAD}$ equal to about −900 volts to form CAD images. When exposed at the exposure station B it is discharged to $V_c$ to $V_{DAD}$ equal to about −100 volts to form a DAD image which in near zero or ground potential in the highlight color (i.e. color other than black) parts of the image. See FIG. 1*a*. The photoreceptor is also discharge to $V_w$ or $V_{mod}$ equal to approximately minus 500 volts in the background (white) areas.

A patch generator 52 (FIGS. 3 and 4) in the form of a conventional exposure device utilized for such purpose is positioned at the patch generation station C. It serves to create toner test patches in the interdocument zone which are used both in a developed and undeveloped condition for controlling various process functions. An Infra-Red densitometer (IRD) 54 is utilized to sense or measure the reflectance of test patches after they have been developed.

After patch generation, the P/R is moved through a first ESV station D where an ESV ($ESV_1$) 55 is positioned for sensing or reading certain electrostatic charge levels (i.e. $V_{DAD}$, $V_{CAD}$, $V_{Mod}$, and $V_{tc}$) on the P/R prior to movement of these areas of the P/R moving through the development station E.

At development station E, a magnetic brush development system, indicated generally by the reference numeral 56 advances developer materials into contact with the electrostatic latent images on the P/R. The development system 56 comprises first and second developer housing structures 58 and 60. Preferably, each magnetic brush development housing includes a pair of magnetic brush developer rollers. Thus, the housing 58 contains a pair of rollers 62, 64 while the housing 60 contains a pair of magnetic brush rollers 66, 68. Each pair of rollers advances its respective developer material into contact with the latent image. Appropriate developer biasing is accomplished via power supplies 70 and 71 electrically connected to respective developer housings 58 and 60. A pair of toner replenishment devices 72 and 73 (FIG. 2) are provided for replacing the toner as it is depleted from the developer housing structures 58 and 60.

Color discrimination in the development of the electrostatic latent image is achieved by passing the photoreceptor past the two developer housings 58 and 60 in a single pass with the magnetic brush rolls 62, 64, 66 and 68 electrically biased to voltages which are offset from the background voltage $V_{Mod}$, the direction of offset depending on the polarity of toner in the housing. One housing e.g. 58 (for the sake of illustration, the first) contains red conductive magnetic brush (CMB) developer 74 having triboelectric properties (i.e. negative charge) such that it is driven to the least highly charged areas at the potential $V_{DAD}$ of the latent images by the electrostatic development field ($V_{DAD}-V_{color\ bias}$) between the photoreceptor and the development rolls 62, 64. These rolls are biased using a chopped DC bias via power supply 70.

The triboelectric charge on conductive black magnetic brush developer 76 in the second housing is chosen so that the black toner is urged towards the parts of the latent images at the most highly charged potential $V_{CAD}$ by the electrostatic development field ($V_{CAD}-V_{black\ bias}$) existing between the photoreceptor and the development rolls 66, 68. These rolls, like the rolls 62, 64, are also biased using a chopped DC bias via power supply 72. By chopped DC (CDC) bias is meant that the housing bias applied to the developer housing is alternated between two potentials, one that represents roughly the normal bias for the DAD developer, and the other that represents bias that is considerably more negative than the normal bias, the former being identified as $V_{Bias\ Low}$ and the latter as $V_{Bias\ High}$. This alternation of the bias takes place in a periodic fashion at a given frequency, with the period of each cycle divided up between the two bias levels at a duty cycle of from 5-10% (Percent of cycle $V_{Bias\ High}$) and 90-95% at $V_{Bias\ Low}$. In the case of the CAD image, the amplitude of both $V_{Bias\ Low}$ and $V_{Bias\ High}$ are about the same as for the DAD housing case, but the waveform is inverted in the sense that the bias on the CAD housing is at $V_{Bias\ High}$ for a duty cycle of 90-95%. Developer bias switching between $V_{Bias\ High}$ and $V_{Bias\ Low}$ is effected automatically via the power supplies 70 and 74. For further details regarding CDC biasing, reference may be had to U.S. patent application Ser. No. 440,913 filed Nov. 22, 1989 in the name of Germain et al and assigned to same assignee as the instant application.

In contrast, in conventional tri-level imaging as noted above, the CAD and DAD developer housing biases are set at a single value which is offset from the background voltage by approximately −100 volts. During image development, a single developer bias voltage is continuously applied to each of the developer structures. Expressed differently, the bias for each developer structure has a duty cycle of 100%.

Because the composite image developed on the photoreceptor consists of both positive and negative toner, a negative pretransfer dicorotron member 100 at the pretransfer station G is provided to condition the toner for effective transfer to a substrate using positive corona discharge.

Subsequent to image development a sheet of support material 102 (FIG. 3) is moved into contact with the toner image at transfer station J. The sheet of support material is advanced to transfer station J by conventional sheet feeding apparatus comprising a part of the paper handling module 8. Preferably, the sheet feeding apparatus includes a feed roll contacting the uppermost sheet of a stack copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station J.

Transfer station J includes a transfer dicorotron 104 which sprays positive ions onto the backside of sheet 102. This attracts the negatively charged toner powder images from the belt 10 to sheet 102. A detack dicorotron 106 is also provided for facilitating stripping of the sheets from the belt 10.

After transfer, the sheet continues to move, in the direction of arrow 108, onto a conveyor (not shown) which advances the sheet to fusing station M. Fusing station M includes a fuser assembly, indicated generally by the reference numeral 120, which permanently affixes the transferred powder image to sheet 102. Preferably, fuser assembly 120 comprises a heated fuser roller 122 and a backup roller 124. Sheet 102 passes between fuser roller 122 and backup roller 124 with the toner powder image contacting fuser roller 122. In this manner, the toner powder image is permanently affixed to sheet 102 after it is allowed to cool. After fusing, a chute, not shown, guides the advancing sheets 102 to a catch trays 126 and 128 (FIG. 2), for subsequent removal from the printing machine by the operator.

After the sheet of support material is separated from photoconductive surface of belt 10, the residual toner particles carried by the non-image areas on the photoconductive surface are removed therefrom. These particles are removed at cleaning station L. A cleaning housing 100 supports therewithin two cleaning brushes 132, 134 supported for counter-rotation with respect to the other and each supported in cleaning relationship with photoreceptor belt 10. Each brush 132, 134 is generally cylindrical in shape, with a long axis arranged generally parallel to photoreceptor belt 10, and transverse to photoreceptor movement direction 16. Brushes 132, 134 each have a large number of insulative fibers mounted on base, each base respectively journaled for rotation (driving elements not shown). The brushes are typically detoned using a flicker bar and the toner so removed is transported with air moved by a vacuum source (not shown) through the gap between the housing and photoreceptor belt 10, through the insulative fibers and exhausted through a channel, not shown. A typical brush rotation speed is 1300 rpm, and the brush/-photoreceptor interference is usually about 2 mm. Brushes 132, 134 beat against flicker bars (not shown) for the release of toner carried by the brushes and for effecting suitable tribo charging of the brush fibers.

Subsequent to cleaning, a discharge lamp 140 floods the photoconductive surface 10 with light to dissipate any residual negative electrostatic charges remaining prior to the charging thereof for the successive imaging cycles. To this end, a light pipe 142 is provided. Another light pipe 144 serves to illuminate the backside of the P/R downstream of the pretransfer dicorotron 100. The P/R is also subjected to flood illumination from the lamp 140 via a light channel 146.

Figure 4:
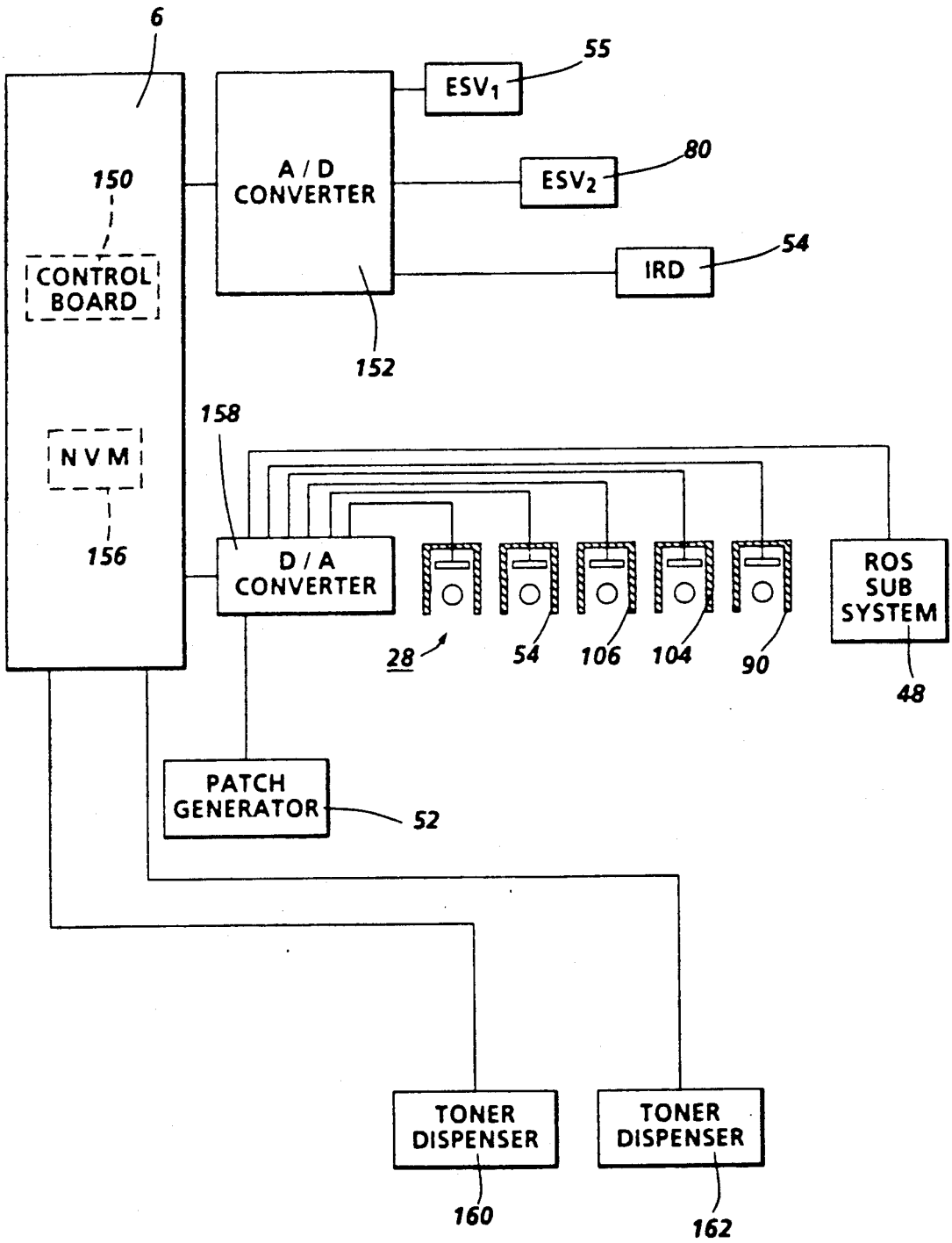
FIG. 4 is a block diagram illustrating the interaction among active components of the xerographic process module and the control devices utilized to control them.

FIG. 4 depicts the interconnection among active components of the xerographic process module 4 and the sensing or measuring devices utilized to control them. As illustrated therein, $ESV_1$, $ESV_2$ and IRD 54 are operatively connected to a control board 150 through an analog to digital (A/D) converter 152. $ESV_1$ and $ESV_2$ produce analog readings in the range of 0 to 10 volts which are converted by Analog to Digital (A/D) converter 152 to digital values in the range 0–255. Each bit corresponds to 0.040 volts (10/255) which is equivalent to photoreceptor voltages in the range 0–1500 where one bit equals 5.88 volts (1500/255).

The digital value corresponding to the analog measurements are processed in conjunction with a Non-Volatile Memory (NVM) 156 by firmware forming a part of the control board 150. The digital values arrived at are converted by a digital to analog (D/A) converter 158 for use in controlling the ROS 48, dicorotrons 28, 54, 90, 100 and 104. Toner dispensers 160 and 162 are controlled by the digital values. Target values for use in setting and adjusting the operation of the active machine components are stored in NVM.

Tri-level xerography requires fairly precise electrostatic control at both development stations. This is accomplished by using $ESV_1$ and $ESV_2$ to measure voltage states on the P/R in test patch areas written in the interdocument zones between successive images. However, because the color developer material reduces the magnitude of the black development field in a somewhat variable manner, it is necessary to read the electrostatics associated with the black development following the color housing.

In such a system it is necessary that the ESVs are reasonably precise in their readings. Although the ESVs can be calibrated to a common source by a service rep, the ESV output is known to drift over time if charged toner particles are deposited within the unit. A single ESV cannot distinguish between charge on the P/R and charge on a toner particle sitting inside the ESV housing.

In the dual ESV control system such as disclosed herein, $ESV_1$ is taken as the reference for calibration purposes since it is less prone to contamination. At each cycle up, following a normal cycle down, there is a portion of the P/R that has been exposed by a multifunctional erase lamp 140 but not charged by the charging system. This portion of the P/R is at or below the residual voltage left on the P/R and experiences very little dark decay.

An ESV output is established to record a one volt offset when it reads zero volts on the P/R. When converted from 0–10 volts analog to 0–255 bits digital, each bit corresponds to 0.040 volts analog which is equivalent to a reading of approximately 5.88 volts on the P/R surface. A P/R voltage of 59 volts, for example will produce an ESV reading of 35 bits, including the 25 bit offset.

At such low voltages, where P/R dark decay is small, both $ESV_1$ and $ESV_2$ should read the same voltage if they are properly calibrated. Contamination by charged particles will change the reading of one or both ESVs.

At each cycle up following a normal cycle down, the relatively uncharged portion of the P/R is read by both ESVs as the P/R is put into motion. Using $ESV_1$ as a reference, the zero offset of $ESV_2$ is adjusted to achieve the same residual P/R voltage reading as $ESV_1$. This new offset is stored in Non-Volatile Memory (NVM) and is used to adjust all subsequent $ESV_2$ voltage readings until a new offset is measured. In this way any contamination of the $ESV_2$ probe by charged particles is eliminated from the $ESV_1$ readings.

What is claimed is:

1. In a method of creating tri-level images on a charge retentive surface during operation of a tri-level imaging apparatus, the steps including:

moving said charge retentive surface past a plurality of process stations including a charging station where said charge retentive surface is uniformly charged, a plurality of developer structures for developing latent images and an illumination station for discharging said charge retentive surface:

using a first sensor, sensing the voltage level of a relatively uncharged portion of said charge retentive surface and generating a first signal representative of said voltage level;

using a second sensor, sensing said relatively uncharged portion of said charge retentive surface and generating a second signal representative of said voltage level;

using one of said sensors as a reference, adjusting the zero offset of the other of said sensors to achieve the same voltage reading as said one of said sensors and generating a signal representative of the amount of adjustment;

storing said signal representative of the amount of adjustment in memory.

2. The method according to claim 1 wherein said steps are initiated during a cycle up period following a normal cycle down of said imaging apparatus.

3. The method according to claim 2 wherein said steps are initiated during a cycle up period following each normal cycle down of said imaging apparatus.

4. The method according to claim 3 wherein said steps are initiated after discharge of said charge retentive surface at said illumination station.

5. The method according to claim 3 wherein said signal representative of the amount of adjustment is utilized for adjusting subsequent sensor measurements between successive normal cycle down periods.

6. The method according to claim 5 wherein said step of using one of said sensors comprises using a sensor which is less prone to contamination by charged particles.

7. The method according to claim 6 wherein the steps of using first and second sensors comprises using electrostatic voltmeters.

8. The method according to claim 1 wherein said step of using one of said sensors comprises using a sensor which is less prone to contamination by charged particles.

9. The method according to claim 8 wherein said steps are initiated during a cycle up period following a normal cycle down of said imaging apparatus.

10. The method according to claim 9 wherein said steps are initiated after discharge of said charge retentive surface at said illumination station.

11. Apparatus for creating tri-level images on a charge retentive surface during operation of a tri-level imaging apparatus, said apparatus comprising:

means for moving said charge retentive surface past a plurality of process stations including a charging station where said charge retentive surface is uniformly charged, a plurality of developer structures for developing latent images and an illumination station for discharging said charge retentive surface;

means for sensing the voltage level of a relatively uncharged portion of said charge retentive surface and generating a first signal representative of said voltage level;

means for sensing said relatively uncharged portion of said charge retentive surface and generating a second signal representative of said voltage level;

means for adjusting the zero offset of the other of said sensors to achieve the same voltage reading as said one of said sensors and generating a signal representative of the amount of adjustment;

means for storing said signal representative of the amount of adjustment in memory.

12. Apparatus according to claim 11 wherein said means for sensing and adjusting are operable during a cycle up period following a normal cycle down of said imaging apparatus.

13. Apparatus according to claim 12 wherein said means for sensing and adjusting are operable during a cycle up period following each normal cycle down of said imaging apparatus.

14. Apparatus according to claim 13 wherein said means for sensing and adjusting are operable after discharge of said charge retentive surface at said illumination station.

15. Apparatus according to claim 13 including means for utilizing said signal representative of the amount of adjustment for adjusting subsequent sensing means measurements between successive normal cycle down periods.

16. Apparatus according to claim 15 wherein one of said sensing means comprises a sensor which is less prone to contamination by charged particles.

17. Apparatus according to claim 16 wherein first and second sensing means comprise electrostatic voltmeters.

18. Apparatus according to claim 11 wherein one of said sensing means comprises using a sensor which is less prone to contamination by charged particles.

19. Apparatus according to claim 18 wherein said means for sensing and adjusting are operable during a cycle up period following a normal cycle down of said imaging apparatus.

20. Apparatus according to claim 19 wherein said means for sensing and adjusting are operable after discharge of said charge retentive surface at said illumination station.

* * * * *